US006558123B1

(12) United States Patent
Spaggiari

(10) Patent No.: US 6,558,123 B1
(45) **Date of Patent: *May 6, 2003**

(54) AXIAL FLOW FAN

(75) Inventor: Alessandro Spaggiari, Correggio (IT)

(73) Assignee: Spal S.r.l., Correggio (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/646,611

(22) PCT Filed: Mar. 18, 1999

(86) PCT No.: PCT/IB99/00459

§ 371 (c)(1),
(2), (4) Date: Sep. 20, 2000

(87) PCT Pub. No.: WO99/49224

PCT Pub. Date: Sep. 30, 1999

(30) Foreign Application Priority Data

Mar. 23, 1998 (EP) ..... 98830169

(51) Int. Cl.[7] ..... F04D 29/38

(52) U.S. Cl. ..... 416/238; 416/169 A; 416/189; 416/192; 416/243; 416/DIG. 2; 415/119

(58) Field of Search ..... 416/169 A, 189, 416/192, 238, 242, 243, DIG. 2, DIG. 5, 175, 203, 235, 237; 415/119

(56) References Cited

U.S. PATENT DOCUMENTS

| | | | | | |
|---|---|---|---|---|---|
| 1,467,699 | A | * | 9/1923 | Vinding et al. | 416/242 |
| 1,853,607 | A | * | 4/1932 | Ferreby | 416/237 |
| 1,929,690 | A | * | 10/1933 | Huntman | 416/238 |
| 3,514,215 | A | * | 5/1970 | Williams | 416/203 |
| 3,822,103 | A | * | 7/1974 | Hori et al. | 416/240 |
| 4,684,324 | A | * | 8/1987 | Perosino | 416/189 |
| 4,893,990 | A | * | 1/1990 | Tomohiro et al. | 416/237 |
| 5,161,953 | A | * | 11/1992 | Burtis | 416/242 |
| 6,302,652 | B1 | * | 10/2001 | Roberts | 416/243 |

FOREIGN PATENT DOCUMENTS

| | | | | |
|---|---|---|---|---|
| DE | 138699 A | * | 11/1979 | 416/203 |
| EP | 553598 A1 | * | 8/1993 | 416/242 |
| GB | 152233 A | * | 10/1920 | 416/242 |
| JP | 6-108997 A | * | 4/1994 | 415/119 |
| JP | 6-249195 A | * | 9/1994 | 415/119 |

* cited by examiner

*Primary Examiner*—Christopher Verdier
(74) *Attorney, Agent, or Firm*—Browdy and Neimark, P.L.L.C.

(57) ABSTRACT

The axial flow fan (1) comprises a central hub (3), a plurality of blades (4), each blade (4) having a root (5) and an end (6) and being delimited also by a convex edge (7), whose projection onto the plane of rotation of the fan is defined by a parabolic segment, and by a concave edge (8) whose projection onto the plane of rotation of the fan is defined by circular arc. The blades (4) consist of sections having aerodynamic profiles (18) with a face **(18*a*) comprising at least one initial straight-line segment (t) and a blade angle (β) that decreases gradually and constantly from the root (5) towards the end (6) of the blade (4)** according to a cubic law of variation as a function of the fan radius.

11 Claims, 5 Drawing Sheets

AXIAL FLOW FAN

CROSS REFERENCE TO RELATED APPLICATION

The present application is the national stage under 35 U.S.C. 371 of PCT/IB99/00459, filed Mar. 18, 1999.

TECHNICAL FIELD

The present invention relates to an axial flow fan equipped with blades inclined in the plane of rotation of the fan.

The fan disclosed by the present invention has diverse applications, for example, to move air through a heat exchanger or radiator in the cooling system of a motor vehicle or similar engine, or to move air through a heat exchanger in the heating system of the interior compartment of a vehicle. In addition, the fan disclosed by the present invention can be used to move air in the fixed air conditioning or heating installations of buildings.

Fans of this kind have to satisfy various different requirements, including low noise, high efficiency, dimensional compactness and good values of head (pressure) and delivery.

BACKGROUND ART

Patent EP-0 553 598 B, in the name of the same Applicant as the present, discloses a fan whose blades have a constant chord length along their entire length. In addition, the leading and trailing edges of the blades form two curves which, if projected onto the plane of rotation of the fan, are two circular arcs. Fans made in accordance with this patent achieve good results in terms of efficiency and low noise but their ability to achieve high head or pressure values is limited mainly because of their small axial dimensions.

The need to achieve high head values has become an increasingly important requirement on account of the thermal units in modern automobiles which include two or more exchangers arranged in series—for example, the condenser of the air conditioning system, the radiator of the cooling system and the heat exchanger for the air supply of turbo engines—or on account of radiators that have become thicker to compensate for the smaller frontal dimensions.

DISCLOSURE OF THE INVENTION

The aim of the present invention is to solve the problem of head or pressure of the above mentioned fans and to further improve them in terms of efficiency and low noise.

The problem is solved by the characteristics described in the independent claim. The dependent claims refer to preferred, advantageous embodiments of the invention.

The invention will now be described with reference to the accompanying drawings which illustrate preferred embodiments of the invention and in which.

Figure 1:
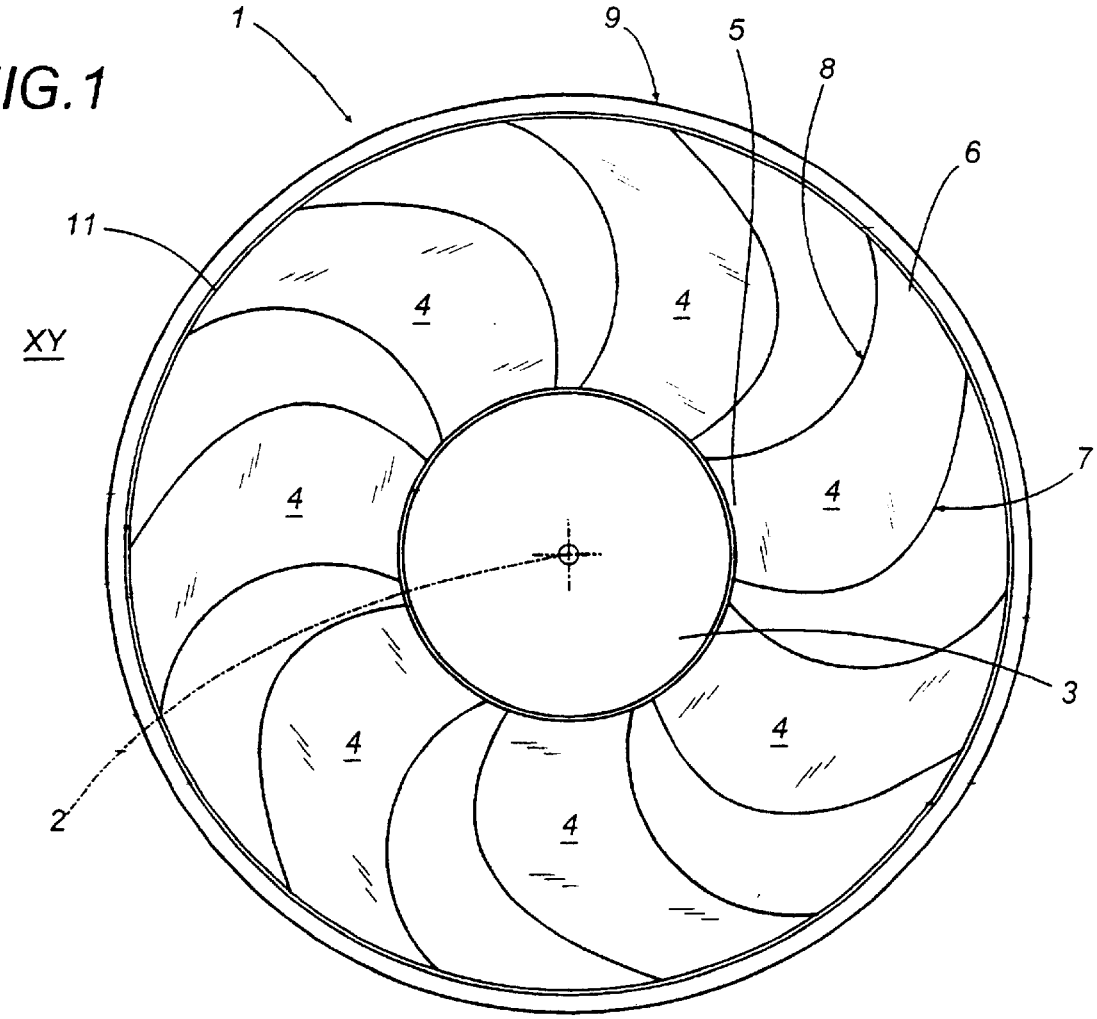
FIG. 1 is a front view of a fan made in accordance with the present invention.
Figure 5:
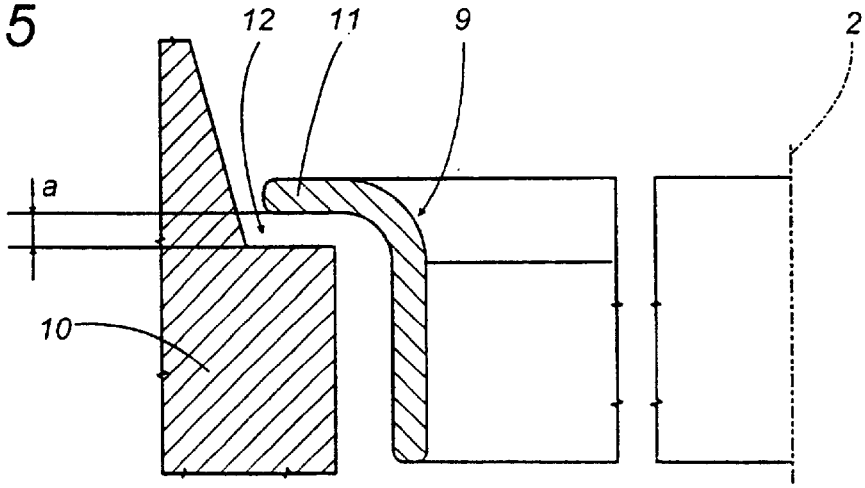
FIG. 5 shows a scaled up detail of the fan illustrated in FIG. 1 and the related duct.

The terms used to describe the fan are defined as follows:

- the chord (L) is the length of the straight-line segment subtended by the arc extending from the leading edge to the trailing edge over an aerodynamic profile of the section of the blade obtained by intersecting the blade with a cylinder whose axis coincides with the axis of rotation of the fan and whose radius r coincides at a point Q;
- the centre line or midchord line (MC) of the blade is the line joining the midpoints of the chords L to the different rays;
- the sweep angle ($\delta$) measured at a given point Q of a characteristic curve of the blade, for example, the curve representing the trailing edge of the fan blade, is the angle made by a ray emanating from the centre of the fan to the point Q concerned and the tangent to the curve at the same point Q;
- the skew angle or net angular displacement ($\alpha$) of a characteristic curve of the blade is the angle between the ray passing through the characteristic curve, for example, the curve representing the midchord line of the blade, to the fan hub, and the ray passing through the characteristic curve at the end of the blade;
- the blade angle ($\beta$) is the angle between the plane of rotation of the fan and the straight line joining the leading edge to the trailing edge of the aerodynamic profile of the blade section;
- the pitch ratio (P/D) is the ratio between the pitch of the helix, that is to say, the amount by which the point Q concerned is axially displaced, that is, $P=2\cdot\pi\cdot r\cdot\tan(\beta)$, where r is the length of the ray to the point Q and $\beta$ is the blade angle at the point Q, and the maximum diameter of the fan;
- the profile camber (f) is the longest straight-line segment perpendicular to the chord L, measured from the chord L to the blade camber line; the position of the profile camber f relative to the chord L may be expressed as a percentage of the length of the chord itself;
- the rake (V) is the axial displacement of the blade from the plane of rotation of the fan, including not only the displacement of the entire profile from the plane of rotation but also the axial component due to the blade curvature, if any—also in axial direction.

With reference to the accompanying drawings, the fan 1 rotates about an axis 2 and comprises a central hub 3 mounting a plurality of blades 4 curved in the plane of rotation XY of the fan 1. The blades 4 have a root 5 and an end 6 and are delimited by a convex edge 7 and a concave edge 8.

Since satisfactory results in terms of efficiency, noise level and head have been obtained by rotating the fan made according to the present invention either in one direction or the other, the convex edge 7 and the concave edge 8 may each be either the leading edge or the trailing edge of the blade.

In other words, the fan 1 may rotate in such a way that the air to be moved meets first with the convex edge 7 and then the concave edge 8 or, vice versa, first with the concave edge 8 and then the convex edge 7.

Obviously, the aerodynamic profile of the blade section must be oriented according to the mode of operation of the fan 1, that is to say, according to whether the air to be moved meets the convex edge 7 or the concave edge 8 first.

At the end 6 of the blades 4, a reinforcement ring 9 may be fitted. The ring 9 strengthens the set of the blades 4 for example by preventing the angle β of the blade 4 from varying in the area at the end of the blade on account of aerodynamic loads. Moreover, the ring 9, in combination with a duct 10, limits the whirling of the air around the fan and reduces the vortices at the end 6 of the blades 4, these vortices being created, as is known, by the different pressure on the two faces of the blade 4.

For this purpose, the ring 9 has a thick lip portion 11, that fits into a matching seat 12 made in the duct 10. The distance (a), very small in the axial direction, between the lip 11 and the seat 12 together with the labyrinth shape of the part between the two elements, reduces air whirl at the end of the fan blades.

Moreover, the special fit between the outer ring 9 and the duct 10 allows the two parts to come into contact with each other while at the same time reducing the axial movements of the fan.

As a whole, the ring 9 has the shape of a nozzle, that is to say, its inlet section is larger than the section through which the air passes at the end of the blades 4. The larger suction surface keeps air flowing at a constant rate by compensating for flow resistance.

Figure 6:
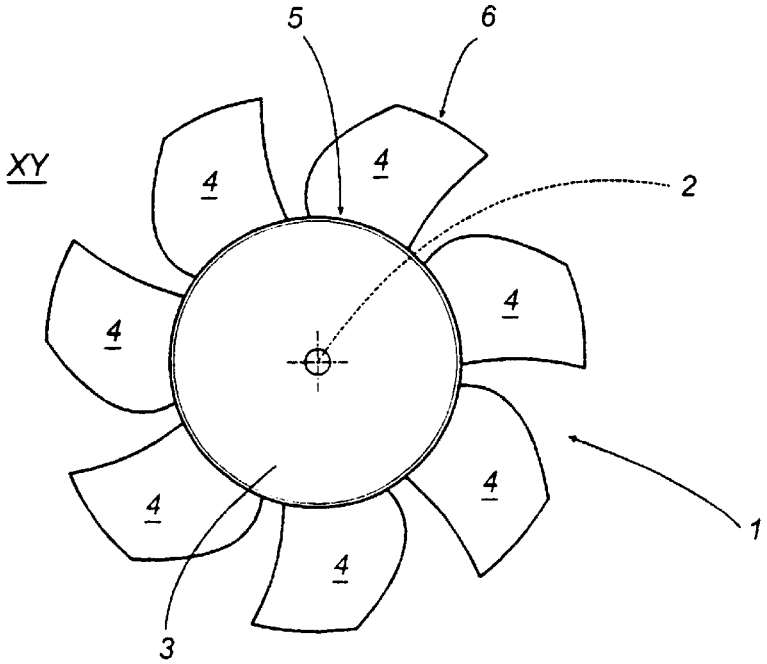
FIG. 6 is a front view of another embodiment of the fan disclosed by the present invention.

However, as shown in FIG. 6, the fan made according to the present invention need not be equipped with the outer reinforcement ring and the related duct.

The blade 4, projected onto the plane of rotation XY of the fan 1, has the geometrical characteristics described below.

The angle at the centre (B), assuming as the centre the geometrical centre of the fan coinciding with the axis of rotation 2 of the fan, corresponding to the width of the blade 4 at the root 5, is calculated using a relation that takes into account the gap that must exist between two adjacent blades 4. In fact, since fans of this kind are made preferably of plastic using injection moulding, the blades in the die should not overlap, otherwise the die used to make the fan has to be very complex and production costs inevitably go up as a result.

Moreover, it should be remembered that, especially in the case of motor vehicle applications, the fans do not work continuously because a lot of the time that the engine is running, the heat exchangers to which the fans are connected are cooled by the air flow created by the movement of the vehicle itself. Therefore, air must be allowed to flow through easily even when the fan is not turning. This is achieved by leaving a relatively wide gap between the fan blades. In other words, the fan blades must not form a screen that prevents he cooling effect of the air flow created by vehicle motion. The relation used to calculate the angle (B) in degrees is:

$$B=(360°/\text{No. of blades})-K;\ K_{min}=\Im(\text{hub diameter; height of blade profile at the hub}).$$

The angle (K) is a factor that takes into account the minimum distance that must exist between two adjacent blades to prevent them from overlapping during moulding and is a function of the hub diameter: the larger the hub diameter is, the smaller the angle (K) can be. The value of the angle (K) may also be influenced by the height of the blade profile at the hub.

The description below, given by way of example only and without restricting the scope of the inventive concept, refers to a practical application of the fan made in accordance with the present invention. As shown in the accompanying drawings, the fan has seven blades, a hub with a diameter of 140 mm and an outside diameter, corresponding to the diameter of the outer ring 9, of 385 mm.

The angle (B), corresponding to the width of a blade at the hub, calculated using these values, is 44°.

The geometry of a blade 4 of the fan 1 will now be described: the blade 4 is first defined as a projection onto the plane of rotation XY of the fan 1 and the projection of the blade 4 onto the plane XY is then transferred into space.

Figure 2:
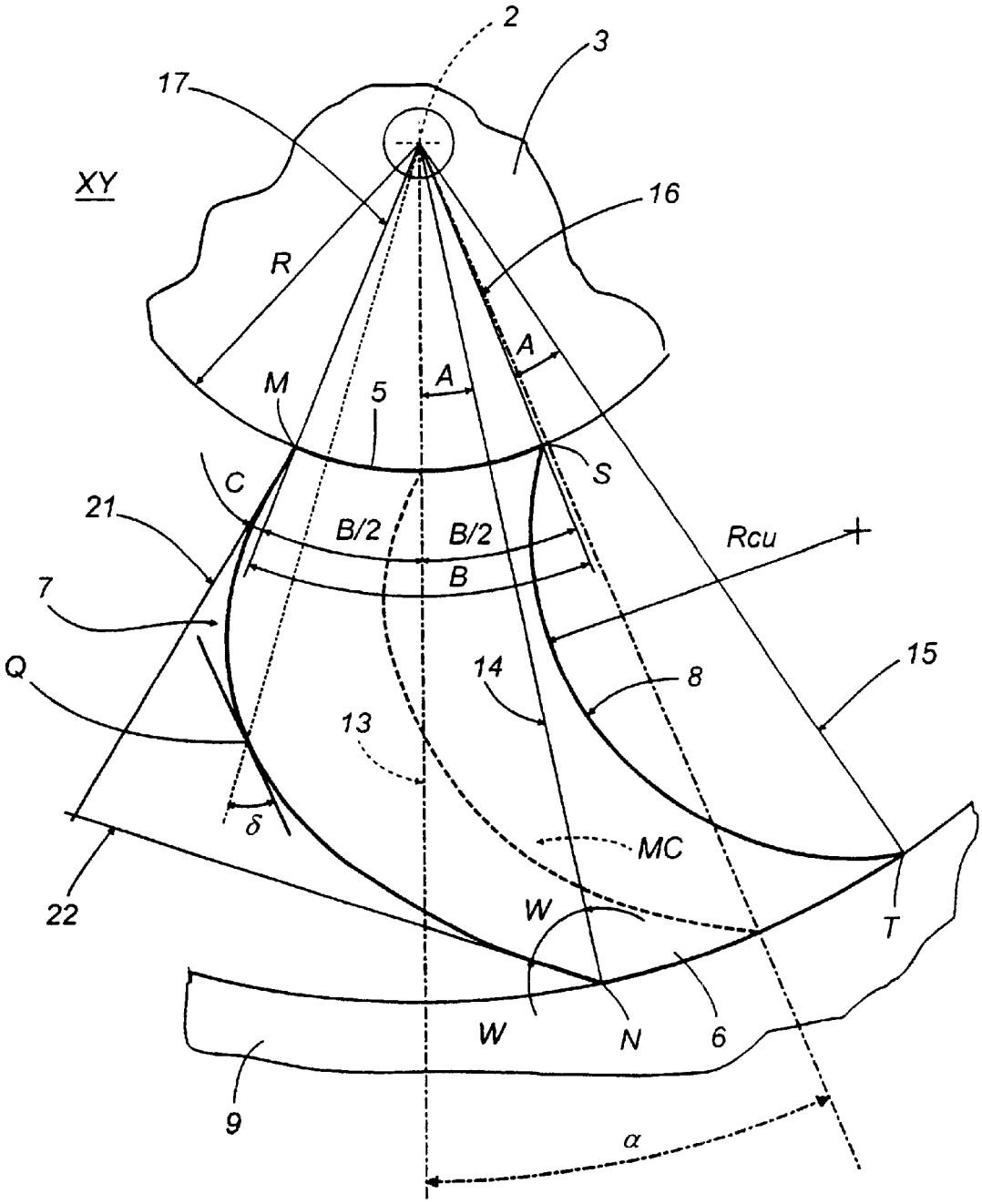
FIG. 2 illustrates in a front view the geometrical features of a blade of the fan disclosed by the present invention.

With reference to the detail shown in FIG. 2, the geometrical construction of the blade 4 consists in drawing the bisector 13 of the angle (B) which is in turn delimited by the ray 17 on the left and the ray 16 on the right. A ray 14, rotated in anticlockwise direction by an angle A=3/11 B relative to the bisector 13, and a ray 15, also rotated in anticlockwise direction by an angle (A) but relative to the ray 16, are then drawn. The two rays 14, 15 are thus both rotated by an angle A=3/11 B, that is, A=12°. The intersections of the rays 17 and 16 with the hub 3 and the intersections of the rays 14 and 15 with the outer ring 9 of the fan (or with a circle equal in diameter to the outer ring 9), determine four points (M, N, S, T) lying in the plane XY, which define the projection of the blade 4 of the fan 1. The projection of the convex edge 7 is also defined, at the hub, by a first tangent 21 inclined by an angle C=3/4 A, that is, C=9°, relative to the ray 17 passing through the point (M) at the hub 3.

As can be seen in FIG. 2, the angle (C) is measured in a clockwise direction relative to the ray 17 and therefore the first tangent 21 is ahead of the ray 17 when the convex edge 7 is the first to meet the air flow, or behind the ray 17 when the convex edge 7 is the last to meet the air flow, that is, when the edge 8 is the first to meet the air flow.

At the outer ring 9, the convex edge 7 is also defined by a second tangent 22 which is inclined by an angle (W) equal to 6 times the angle (A), that is, 72°, relative to the ray 14 passing through the point (N) at the outer ring 9. As shown in FIG. 2, the angle (W) is measured in an anticlockwise direction relative to the ray 14 and therefore the second tangent 22 is ahead when the convex edge 7 is the first to meet the air flow, or behind the ray 14 when the convex edge 7 is the last to meet the air flow, that is, when the edge 8 is the first to meet the air flow.

In practice, the projection of the convex edge 7 is tangent to the first tangent 21 and to the second tangent 22 and is characterized by a curve with a single convex portion, without flexions. The curve which defines the projection of the convex edge 7 is a parabola of the type:

$$y=ax^2+bx+c.$$

In the embodiment illustrated, the parabola is defined by the following equation:

$$y=0.013x^2-2.7x+95.7.$$

Figure 7:
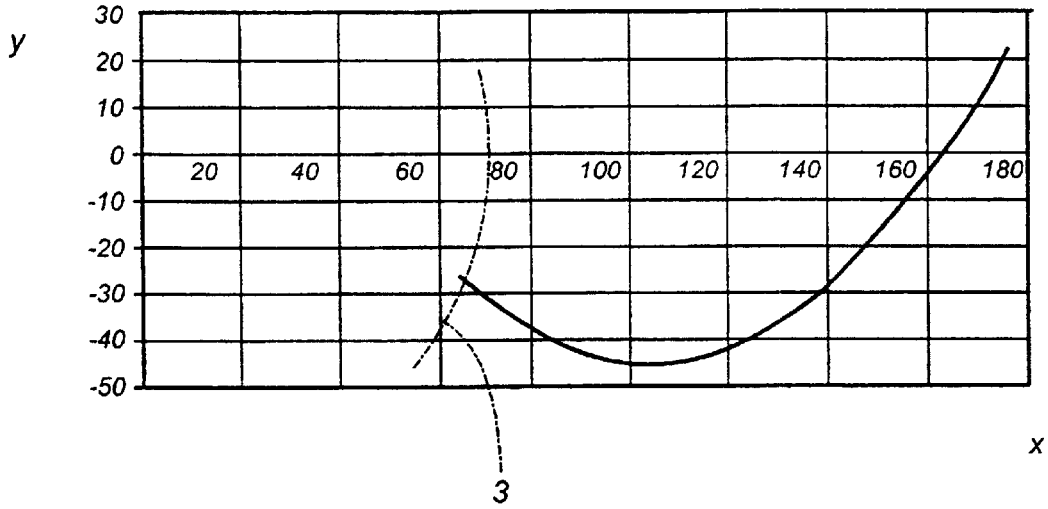
FIG. 7 shows a diagram representing, in Cartesian coordinates, the convex edge of a blade of the fan disclosed by the present invention.

This equation determines the curve illustrated in the Cartesian diagram, shown in FIG. 7, as a function of the related x and y variables of the plane XY.

Looking at FIG. 2 again, the endpoints of the parabola are defined by the tangents 21 and 22 at the points (M) and (N) and the zone of maximum convexity is that nearest the hub 3.

Experiments have shown that the convex edge 7, with its parabolic projection onto the plane of rotation XY of the fan, provides excellent efficiency and noise characteristics.

As regards the projection of the concave edge 8 of the blade 4 onto the plane XY, any second degree curve arranged in such a way as to define a concavity can be used. For example, the projection of the concave edge 8 may be defined by a parabola similar to that of the convex edge 7 and arranged in substantially the same way.

In a preferred embodiment, the curve defining the projection of the concave edge 8 onto the plane XY is a circular arc whose radius ($R_{cu}$) is equal to the radius (R) of the hub and, in the practical application described here, the value of this radius is 70 mm.

As shown in FIG. 2, the projection of the concave edge 8 is delimited by the points (S) and (T) and is a circular arc whose radius is equal to the radius of the hub. The projection of the concave edge 8 is thus completely defined in geometrical terms.

Figure 3:
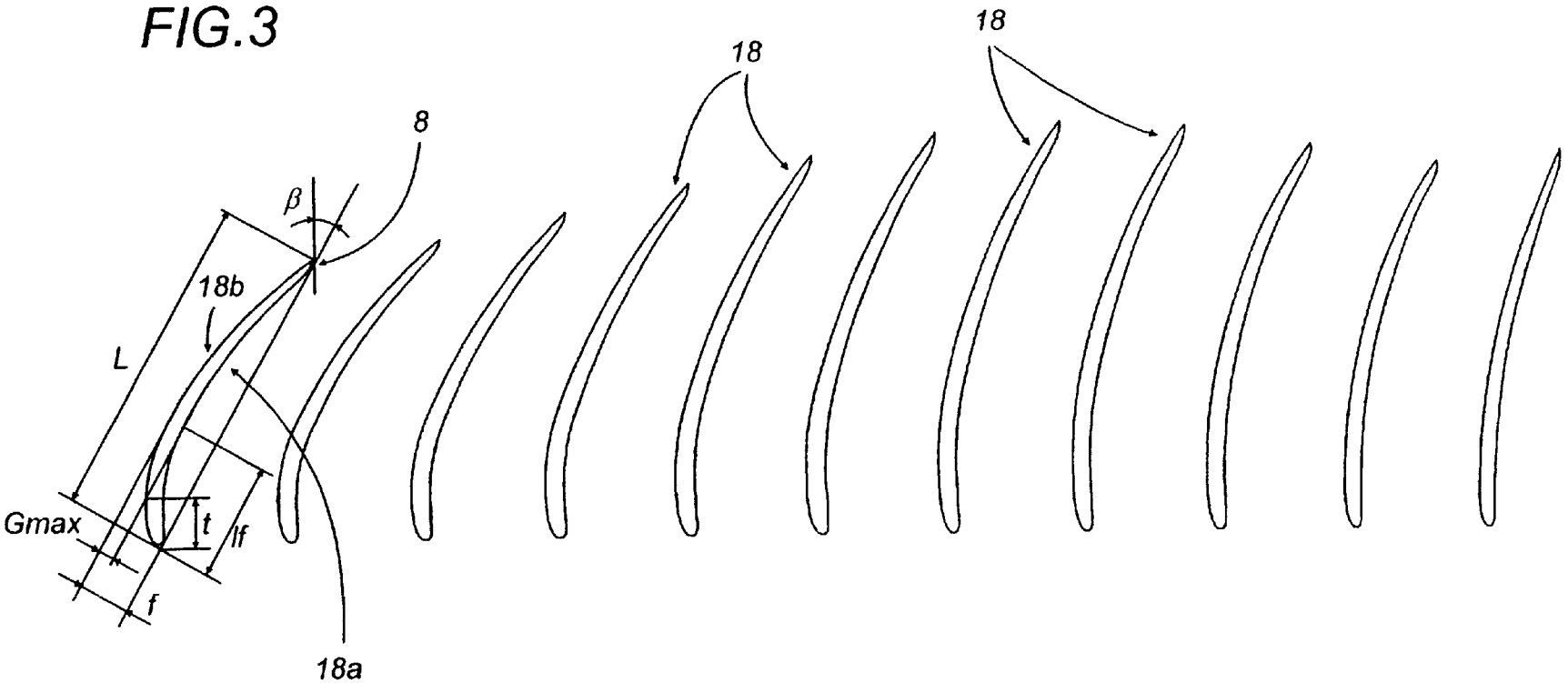
FIG. 3 shows sections of a blade of the fan disclosed by the present invention taken at regular intervals starting from the hub to the end of the blade.

FIG. 3 shows eleven profiles 18 representing eleven sections of the blade 4 made at regular intervals from left to right, that is, from the hub 3 to the outer edge 6 of the blade 4. The profiles 18 have some characteristics in common but are all geometrically different in order to be able to adapt to the aerodynamic conditions which are substantially a function of the position of the profiles in the radial direction. The characteristics common to all the blade profiles are particularly suitable for achieving high efficiency and head and low noise.

The first profiles on the left are more arched and have a larger blade angle (β) because, being closer to the hub, their linear velocity is less than that of the outer profiles.

The profiles 18 have a face 18*a* comprising an initial straight-line segment. This straight-line segment is designed to allow the air flow to enter smoothly, preventing the blade from "beating" the air which would interrupt smooth air flow and thus increase noise and reduce efficiency. In FIG. 3, this straight-line segment is labelled (t) and its length is from 14% to 17% of the length of the chord (L).

The remainder of the face 18*a* is substantially made up of circular arcs. Passing from the profiles close to the hub towards those at the end of the blade, the circular arcs making up the face 18*a* become larger and larger in radius, that is to say, the profile camber (f) of the blade 4 decreases.

With respect to the chord (L), the profile camber (f) is located at a point, labelled (lf) in FIG. 3, between 35% and 47% of the total length of the chord (L). This length must be measured from the edge of the profile that meets the air first.

The back 18*b* of the blade is defined by a curve such that the maximum thickness ($G_{max}$) of the profile is located in a zone between 15% and 25% of the total length of the blade chord and preferably at 20% of the length of the chord (L). In this case too, this length must be measured from the edge of the profile that meets the air first.

Moving from the profiles closer to the hub where the maximum thickness ($G_{max}$) has its highest value, the thickness of the profile 18 decreases at a constant rate towards the profiles at the end of the blade where it is reduced by about a quarter of its value. The maximum thickness ($G_{max}$) decreases according to substantially linear variation as a function of the fan radius. The profiles 18 of the sections of the blade 4 at the outermost portion of the fan 1 have the lowest ($G_{max}$) thickness value because their aerodynamic characteristics must make them suitable for higher speeds. In this way, the profile is optimized for the linear velocity of the blade section, this velocity obviously increasing with the increase in the fan radius.

The length of the chord (L) of the profiles (18) also varies as a function of the radius.

The chord length (L) reaches its highest value in the middle of the blade 4 and decreases towards the end 6 of the blade so as to reduce the aerodynamic load on the outermost portion of the fan blade and also to facilitate the passage of the air when the fan is not operating, as stated above.

The blade angle (β) also varies as a function of the fan radius. In particular, the blade angle (β) decreases according to a quasi-linear law.

The law of variation of the blade angle (β) can be chosen according to the aerodynamic load required on the outermost portion of the fan blade.

In a preferred embodiment, the variation of the blade angle (β) as a function of the fan radius (r) follows a cubic law defined by the equation $$(\beta)=-7\cdot10^{-6}\cdot r^3+0.0037\cdot r^2-0.7602r+67.64$$

Figure 8:
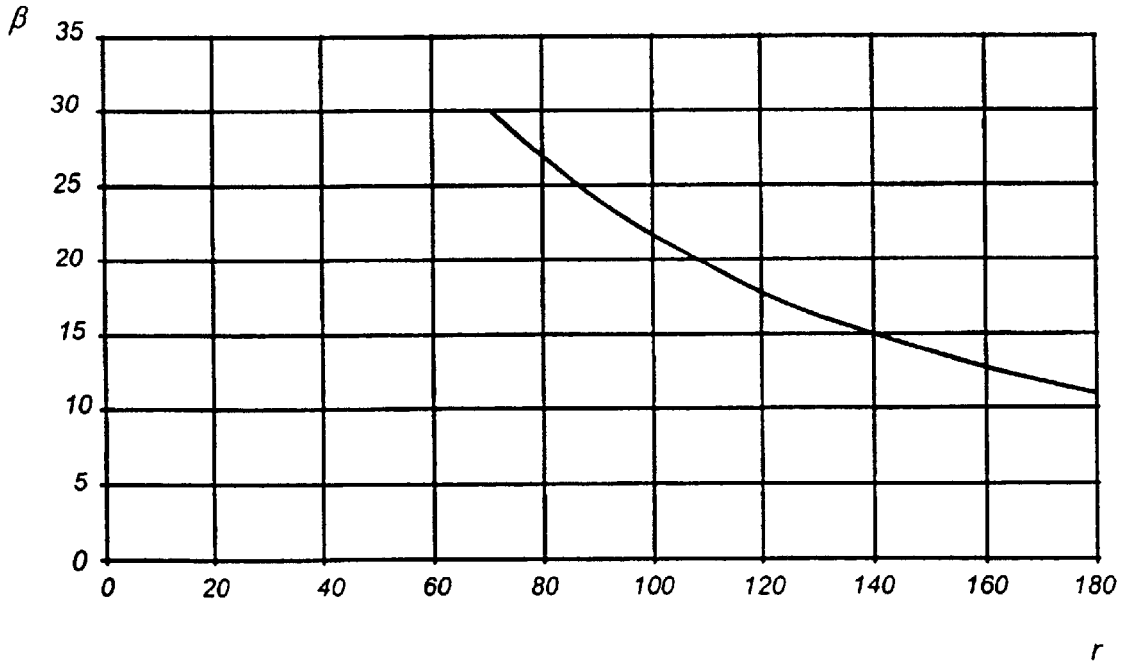
FIG. 8 is a diagram showing the changes in the blade angle in different sections of a blade as a function of the radius of the fan disclosed by the present invention.

The law of variation of (β) as a function of the fan radius (r) is represented in the diagram shown in FIG. 8.

Figure 4:
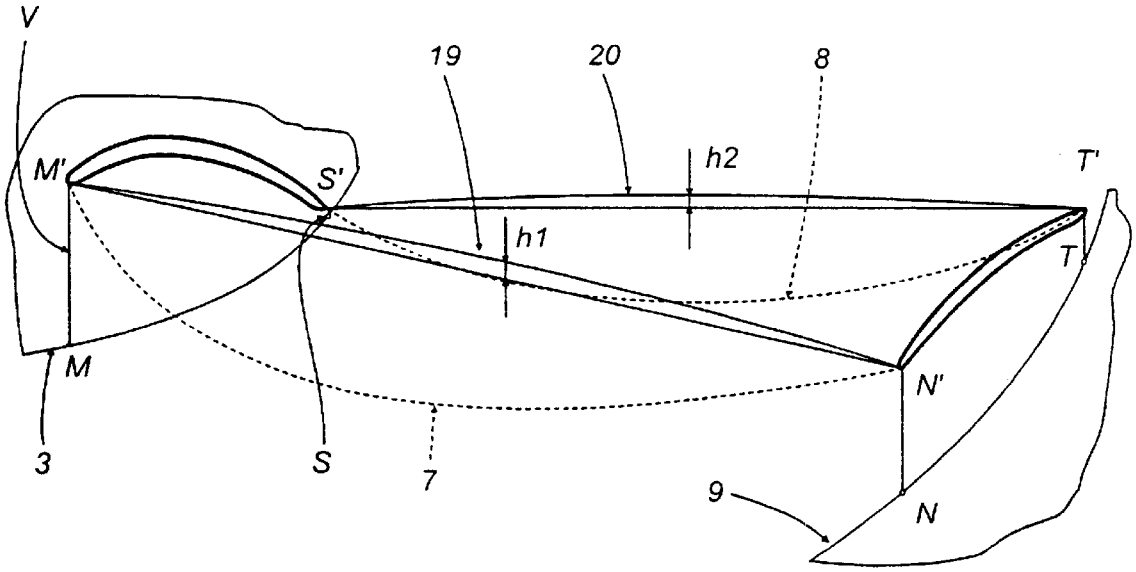
FIG. 4 illustrates in a perspective view other geometrical features of a blade of the fan disclosed by the present invention.

FIG. 4 shows how the projection of the blade 4 in the plane XY is transferred into space. The blade 4 has a rake V relative to the plane of rotation of the fan 1.

FIG. 4 shows the segments joining the points (M', N') and (S', T') of a blade (4).

These points (M', N', S', T') are obtained by starting from the points (M, N, S, T) which lie in the plane XY and drawing perpendicular segments (M, M'), (N, N'), (S, S'), (T, T') which thus determine a rake (V) or, in other words, a displacement of the blade 4 in axial direction.

Moreover, in the preferred embodiment, each blade 4 has a shape defined by the arcs 19 and 20 in FIG. 4. These arcs 19 and 20 are circular arcs whose curvature is calculated as a function of the length of the straight-line segments (M', N') and (S', T'). As shown in FIG. 4, the arcs 19 and 20 are offset from the corresponding straight-line segments (M', N') and (S', T') by lengths (h1) and (h2) respectively. These lengths (h1) and (h2) are measured on the perpendicular to the plane of rotation XY of the fan 1 and are calculated as a percentage of the length of the segments (M', N') and (S', T') themselves.

The dashed lines in FIG. 4 are the curves—parabolic segment and circular arc—related to the convex edge 7 and to the concave edge 8.

The rake V of the blade 4, both as regards its axial displacement component and as regards curvature makes it possible to correct blade flexions due to aerodynamic load and to balance the aerodynamic moments on the blade in such a way as to obtain uniform axial air flow distributed over the entire front surface of the fan.

All the characteristic values of the fan blade, according to the embodiment described, are summarized in the table below where r is the generic fan radius and the following geometrical variables refer to the corresponding radius value:

L indicates the chord length;

f indicates the profile camber t indicates the initial straight-line segment of the blade section;

lf indicates the position of the profile camber relative to the chord L;

β indicates the angle of the blade section profile in sexagesimal degrees;

x and y indicate the Cartesian coordinates in the plane XY of the parabolic edge of the blade.

| | | | | | |
|---|---|---|---|---|---|
| r | 70 | 100.6 | 131.2 | 161.9 | 179 |
| L | 59.8 | 68.7 | 78.2 | 73 | 71.2 |
| f | 8.2 | 7.5 | 7.8 | 6.7 | 5 |
| t | 10 | 10.5 | 11 | 10.5 | 10 |
| lf | 21 | 25.5 | 31.2 | 32.8 | 33 |
| β | 30.1 | 21.9 | 15.7 | 13.3 | 11.1 |
| x | 65.3 | 93.2 | 126.1 | 161.9 | 176.4 |
| y | −25.2 | −43.0 | −38.1 | −0.7 | 23.9 |

Experiments have shown that the fans made in accordance with the present invention have a noise level 25–30%, measured in dB(A), lower than conventional fans of this kind, with a considerable improvement in acoustic comfort, meaning by this that the noise generated was much more "pleasant" than that of conventional fans.

Moreover, under the same conditions of air delivery, the fans made according to the present invention develop head values up to 50% greater than conventional fans of this kind.

In fans made according to the present invention, passing from a blades back to a blades forward configuration does not result in any appreciable change in noise level. Moreover, under certain working conditions, in particular in the high head range, the blades forward configuration delivers 20–25% more than the blades back configuration.

What is claimed is:

1. An axial flow fan (1) having a geometrical centre, rotating in a rotation plane (XY) about an axis (2) coinciding with the geometrical centre of the fan (1), the fan (1) including a central hub (3), a plurality of blades (4) each having a root (5) and an end (6), each blade (4) being also delimited by a convex edge (7) and a concave edge (8) and consisting of blade sections with aerodynamic profiles (18), said aerodynamic profiles (18) having a leading edge, a trailing edge and having a blade angle (β) which decreases gradually and constantly from the root (5) towards the end (6) of the blade (4), the blade angle (β) being defined as the current angle between the rotation plane (XY) and a straight line joining the leading edge to the trailing edge of the aerodynamic profile (18) of each blade section, the improvement comprising: the projection of the convex edge (7) onto the rotation plane (XY) is defined by a parabolic segment.

2. The fan according to claim 1 characterized in that each blade (4) projected onto the rotation plane (XY) is delimited by four points (M, N, S, T) lying in the plane (XY) and defined as a function of a blade width angle (B), said blade width angle (B) having a bisector (13), being subtended at the centre of the fan, being defined by a first ray (17) and a second ray (16) emanating from the centre of the fan and corresponding to the width of a single blade (4) at the root (5); each blade (4) being characterized also in that the four points (M, N, S, T) are determined by the following geometric characteristics:

the first point (M) is located at the intersection of the hub (3) and the blade, or at the intersection of the root (5) of the blade (4) with the first ray (17) defining the blade width angle (B);

the second point (S) adjacent to the first point (M) is located at the intersection of the hub (3) and the blade, or at the intersection of the root (5) of the blade (4) with the second ray (16) defining the blade width angle (B);

the third point (N) is located at the end (6) of the blade (4) and is displaced in an anticlockwise direction by an advance angle (A)=3/11_*(B) relative to the bisector (13) of the blade width angle (B);

the fourth point (T) adjacent to the third point (N) is located at the end (6) of the blade (4) and is displaced in the anticlockwise direction by the advance angle (A)=3/11_*(B) relative to the second ray (16) emanating from the geometrical centre of the fan and passing through the second point (S).

3. The fan according to claim 2 characterized in that the projection of the convex edge (7) onto the rotation plane (XY) at the first point (M) has a first tangent (21) inclined by a first tangent angle (C) equal to three quarters of the advance angle (A) relative to the first ray (17) passing through the first point (M); and characterized also in that the projection of the convex edge (7) onto the rotation plane (XY) at the third point (N) has a second tangent (21) inclined by a second tangent angle (W) equal to six times the advance angle (A) relative to a third ray (14) passing through the geometrical centre of the fan (1) and said third point (N); the first and second tangents (21, 22) being ahead of the respective first and third rays (17, 14) when the direction of rotation of the fan (1) is such that the convex edge (7) corresponds to the leading edge of the aerodynamic profile (18) of each blade section and the first and second tangents (21, 22) are arranged in such a way as to define a curve, in the rotation plane (XY), that has a single convex portion without flexions.

4. The fan according to claim 1 characterized in that the blades (4) are formed of sections whose aerodynamic profiles (18) each have a blade angle (β) that decreases gradually and constantly from the root (5) towards the end (6) of the blade (4) according to a cubic law of variation as a function of the radius of the fan at which said sections are located.

5. The fan according to claim 1 characterized in that the projection of the concave edge (8) onto the plane (XY) is defined by a second degree curve segment.

6. The fan according to claim 5 characterized in that the projection of the concave edge (8) onto the plane (XY) is defined by a circular arc.

7. The fan according to claim 6 characterized in that the circular arc formed by the projection of the concave edge (8) onto the plane (XY) has a radius ($R_{cu}$) equal to the radius (R) of the hub (3).

8. The fan according to claim 1 characterized in that the projection of the concave edge (8) onto the plane (XY) is defined by a parabolic segment.

9. The fan according to claim 1 characterized in that the aerodynamic profiles (18) have a face **(18*a*)** comprising at least one initial straight-line segment (t).

10. The fan according to claim 9 characterized in that the aerodynamic profiles (18) have a face **(18*a*)** comprising a segment, following the initial segment (t), that is substantially made up of circular arcs.

11. The fan according to claim 9 characterized in that the aerodynamic profiles (18) each have a chord length (L) and a back **(18*b*) defined by a convex curve which, in combination with the face (18*a*)**, determines a maximum thickness value ($G_{max}$) of the profile in a zone between 15% and 25% of the total length of the chord (L) measured from the leading edge.

* * * * *